US010709951B2

(12) United States Patent
Khan

(10) Patent No.: US 10,709,951 B2
(45) Date of Patent: Jul. 14, 2020

(54) PORTABLE FIGHTING OPPONENT FOR BOXING, MARTIAL ARTS, OR ANY FIGHTING ARTS

(71) Applicant: Mohammad Sohail Ali Khan, Ridgewood, NY (US)

(72) Inventor: Mohammad Sohail Ali Khan, Ridgewood, NY (US)

( * ) Notice: Subject to any disclaimer, the term of this patent is extended or adjusted under 35 U.S.C. 154(b) by 88 days.

(21) Appl. No.: 16/055,096

(22) Filed: Aug. 4, 2018

(65) Prior Publication Data

US 2020/0038730 A1 Feb. 6, 2020

(51) Int. Cl.
*A63B 69/26* (2006.01)
*A63B 69/00* (2006.01)

(52) U.S. Cl.
CPC ..... *A63B 69/26* (2013.01); *A63B 69/004* (2013.01)

(58) Field of Classification Search
CPC ..... A63B 69/004; A63B 69/20; A63B 69/26; A63B 69/34; A63B 69/345; A63B 69/24
USPC ..... 482/83, 86, 87, 88; 473/441, 444
See application file for complete search history.

(56) References Cited

U.S. PATENT DOCUMENTS 5,281,191 A * 1/1994 DeSousa ..... A63B 69/34 473/442
5,501,649 A * 3/1996 Queppet ..... A63B 69/004 434/247
5,700,230 A * 12/1997 Cardona ..... A63B 69/34 482/83
9,498,693 B1 * 11/2016 Kraus ..... A63B 69/345
2012/0238414 A1 * 9/2012 Blaies ..... A63B 69/34 482/83
2013/0296141 A1 * 11/2013 Partlo ..... A63B 69/34 482/84
2015/0057131 A1 * 2/2015 Manley ..... A63B 69/004 482/83
2016/0101338 A1 * 4/2016 Daniels ..... A63B 69/004 482/8
2018/0028891 A1 * 2/2018 DeLaRosa ..... A63B 69/004
2019/0009160 A1 * 1/2019 Penna ..... A63B 69/203
2019/0275397 A1 * 9/2019 Branch ..... A63B 71/08
2019/0388755 A1 * 12/2019 Hall ..... A63B 69/004

* cited by examiner

*Primary Examiner* — William V Gilbert

(57) ABSTRACT

A portable shield made for individuals who practice boxing, martial arts, or any combat sport. The portable shield comprises a central striking area, a resilient neck-like striking area, a head-like striking area that are suitable for kicking and/or punching. The portable shield also comprises holding arms for steering the shield and a spring within the resilient neck-like striking area for allowing movement of the head-like striking area when it is stricken by a user/athlete. The head-like striking area, the resilient neck-like striking area and the central striking area are covered with padding material to prevent injuring the user/athlete when kicking and/or punching.

9 Claims, 8 Drawing Sheets

PORTABLE FIGHTING OPPONENT FOR BOXING, MARTIAL ARTS, OR ANY FIGHTING ARTS

FIELD OF THE INVENTION

The present invention relates to a portable shield/training device made for individuals who practice boxing, martial arts, or any combat sport. The portable shield creates the illusion of actually sparring with someone without having to hold back. It is built just like a human's upper body including a central/abdominal striking area, a resilient neck-like striking area and a head-like striking area that are suitable for body and headshots. This portable shield helps to fix the athlete's distance, timing, accuracy, speed, power, stamina and explosiveness. Not only does it help the athlete that is punching or kicking it, but also helps the strength, reflexes, speed, and stamina of the holder. As an athlete trained in Taekwondo and kickboxing since 1985 and coaching students in my own Taekwondo School, I saw the need for a more realistic way to train my students in preparation for tournaments that required a more non-conventional way of training. I observed that with a stationary punching bag, my students were not learning and building their own combat strategy simply because a punching bag does not have the same movements and counter-movements that an opponent in a ring, or a tournament would have. It is easy to kick and punch an object that does not move. It is different and quite difficult to hit a moving target. This is the reason why I came up with my invention. The portable shield/opponent simulates a real person's movements because it is modeled after a real combatant. The device looks like a real person, even wearing a chest guard like a real opponent would so as to help martial arts and boxing students visualize their game/fighting strategy and thus help them build confidence for tournaments all while they train and learn how to defend themselves. The portable shield/opponent will help martial arts, boxing students and fighting arts athletes in general to think, move, react and strike in more realistic combat situations.

BACKGROUND

State-of-the-art fighting art training equipment typically does not simulate the free movement of the athlete/fighter. For instance, BOB is training equipment currently available in the market. BOB is a kicking dummy very similar to a punching bag with the disadvantage being that it is stationary and does not have the capability to move around like a real person/combatant/opponent would. It does not help the athlete gain a sense of distance, timing, sharpen reflexes, and refine movements.

SUMMARY OF THE INVENTION

It is an object of the present invention to solve the problems present in current fighting arts training equipment by providing a device such as the portable shield/opponent. The portable shield is designed to fulfill any combat sport requirement such as boxing and martial arts. It can assist an athlete to gain a sense of the distance of a challenger, the timing, reflexes, and accuracy of shots. It also helps with an athlete's speed, power, stamina, and explosiveness of kicks and punches. Most of all, it will aid the athlete in planning his/her fight strategy while engaged in the combat.

The portable shield not only helps the athlete with kicking and punching but also helps the holder as well. The holder (person carrying the portable shield) gets to build his/her strength, reflexes, speed and stamina. These benefits are not demonstrated with the other devices currently on the market such as punching bags and BOB.

The portable shield can be used by athletes who box, do martial arts or any combat sport. The portable shield has a round body "central striking area" that wraps around the holder's rib cage. On top of the body are a neck and a head attached. The head and neck are sturdy enough to take a full-blown head shot without breaking. The neck moves and bounces back into place just like a human's neck. To attach the portable shield onto the holder, Velcro belts "straps assembly" are provided and crisscrossed against the holders back.

The portable shield has a thick cushion on its back, which is placed on the holder's chest to prevent the head of the device/portable shield slamming against the holders face. This cushion also helps level the portable shield onto the holder's body regardless of his/her body type.

The interior of the portable shield device preferably consists of a metal frame structure (aluminum and steel) with a spring that works as the backbone of the whole invention. The interior frame structure is not limited to be made of metal but can be made of other suitable materials, like plastic, wood, composite materials and other commercially available materials. Over the interior frame structure is foam/padding material and multiple layers of chest protectors/padding that are soft enough to keep the athlete from injuring him/herself. On the back of the interior frame structure also there is foam/padding material that is used to absorb the impact against the holder. The head of the Opponent is sturdy due to the fact that there is a two-inch-thick spring that is holding up the head frame structure. This head frame structure is covered in thick foam/padding material and it has a helmet "head guard" on top to keep the athlete from getting injured, Attached to the shoulder area of the Opponent are two handles "holding arms" that are used by the holder to push out the shield and to better steer it. These handles are shielded by thick pieces of foam/padding material to avoid the athlete kicking or punching them and it also protects the holder's hands from getting hit.

The interior frame structure comprises a head frame structure, a spring frame structure "spring", a chest frame structure, a holding arms frame structure, a spine frame structure, abdomen frame structure and a lower abdomen frame structure. The head frame structure is wrapped with protection foam/padding material to form a head-like striking area, wherein the spring is wrapped with padding material to form a resilient neck-like striking area; the holding arms frame structure is wrapped with a protection foam/padding material. The chest frame structure, the spine frame structure, the abdomen frame structure and the lower abdomen frame structure are all wrapped with protection foam/padding material to form a central striking area, wherein holding arms are connected to the chest frame structure. The head frame structure, the spring neck structure, the chest frame structure, the holding arms frame structure, the spine frame structure, the abdomen frame structure and a lower abdomen frame structure are connected to each other via welding and/or bolts or any other suitable fastening mechanism may be used.

The chest guard, head guard and the neck guard are interchangeable to different length sizes so that regardless of the height of the athlete or which sport the athlete engages in, he/she will be able to use the portable shield device with the chest/head/neck guard that corresponds with that sport or height of athlete. The padding layers of the chest guard, head guard and the neck guard is also removable/interchangeable so the athlete may change how soft or hard they want the portable shield device to be.

The portable shield weighs about 9 kilograms. This weight helps the holder build his/her strength and stamina. This weight also helps absorb the impact of the kicks and punches of the athlete.

The best part of the portable shield device is that a lightweight athlete can move around with a heavier weight athlete for a sense of distance, timing, and reflexes without getting injured.

The portable shield device helps the athlete use his/her judgment when sparring. The athlete must use their judgment for distance, timing, power, and technique. No one has to coach the athlete on which technique or strike to use. It is the athlete's responsibility to figure out how to attack or counter attack depending on the situation at hand.

The shield device may be mounted on a special, iron-made stand. This stand will act as a replacement if the athlete does not have a holder. There are also attachable and detachable arms and legs that can be mounted to the shield device to give the athlete more of the sense of fighting a real life person.

The portable shield device may include a data collection/transmission control unit configured to gather information during each training session. The collected information by the data collection/transmission control unit can be downloaded to a user's/athlete's smart phone. The data collection/transmission unit can measure the duration time of each training session, athlete's heart rate, how many calories were burned by the athlete, rhythm, the power and speed of kicks and punches among other parameters. The data collection/transmission control unit also includes a timer that the athlete can use to time his/her rounds.

DETAILED DESCRIPTION OF THE INVENTION

The description is not intended to be limiting, it is made solely for the purpose of illustrating the principles of the invention.

Figure 1:
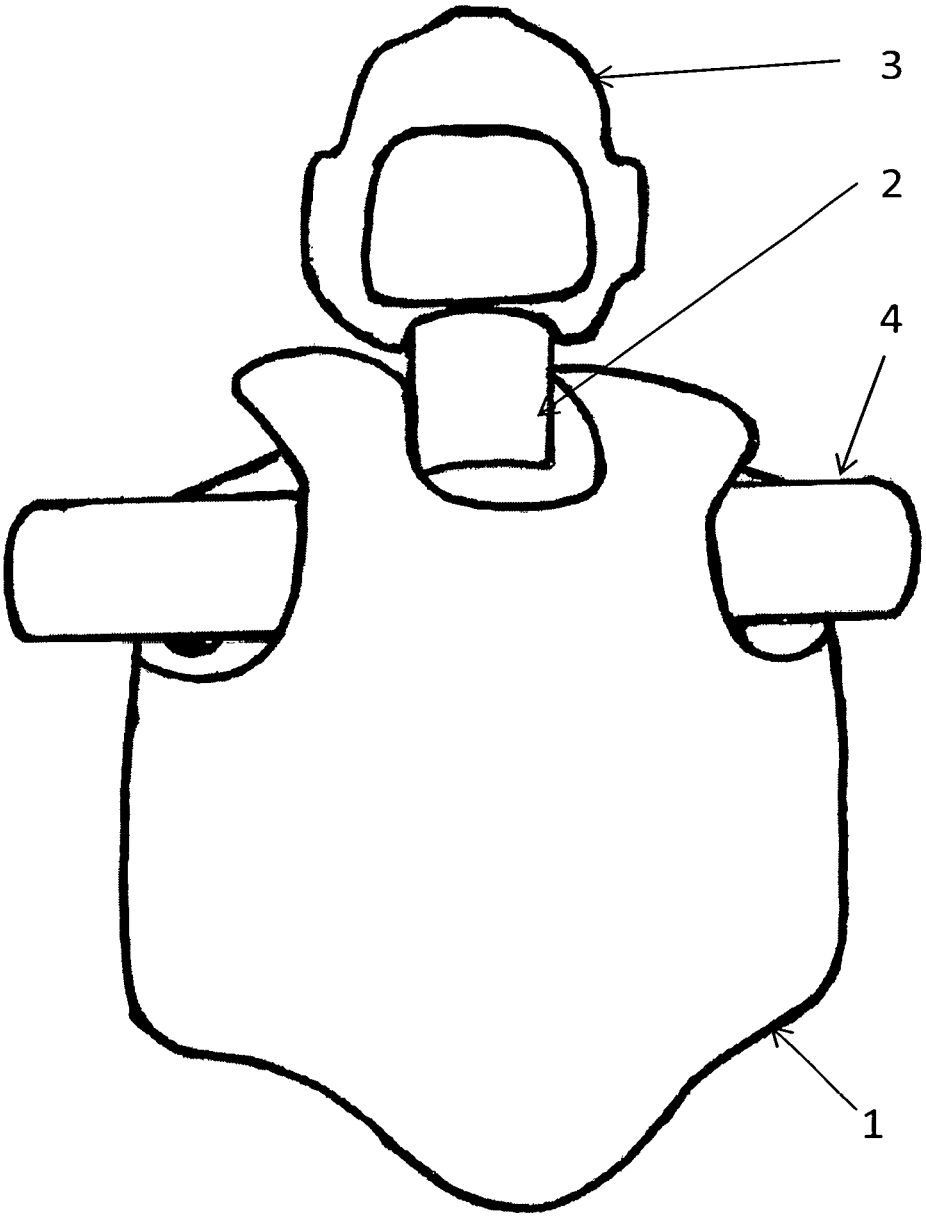
FIG. 1 schematically illustrates the assembled kicking/punching device according to the present invention.

Referring now to the drawings in detail, where like numerals refer to like parts or elements, there is shown in FIG. 1, The portable shield comprises a central striking area 1 connected to a resilient neck-like striking area 2 and to a head-like striking area 3 and holding arms 4 extending out from the central striking area 1. The resilient neck-like striking area 2 can be made interchangeable to different length sizes so that athletes of different heights can use the portable shield/training device.

Figure 2:
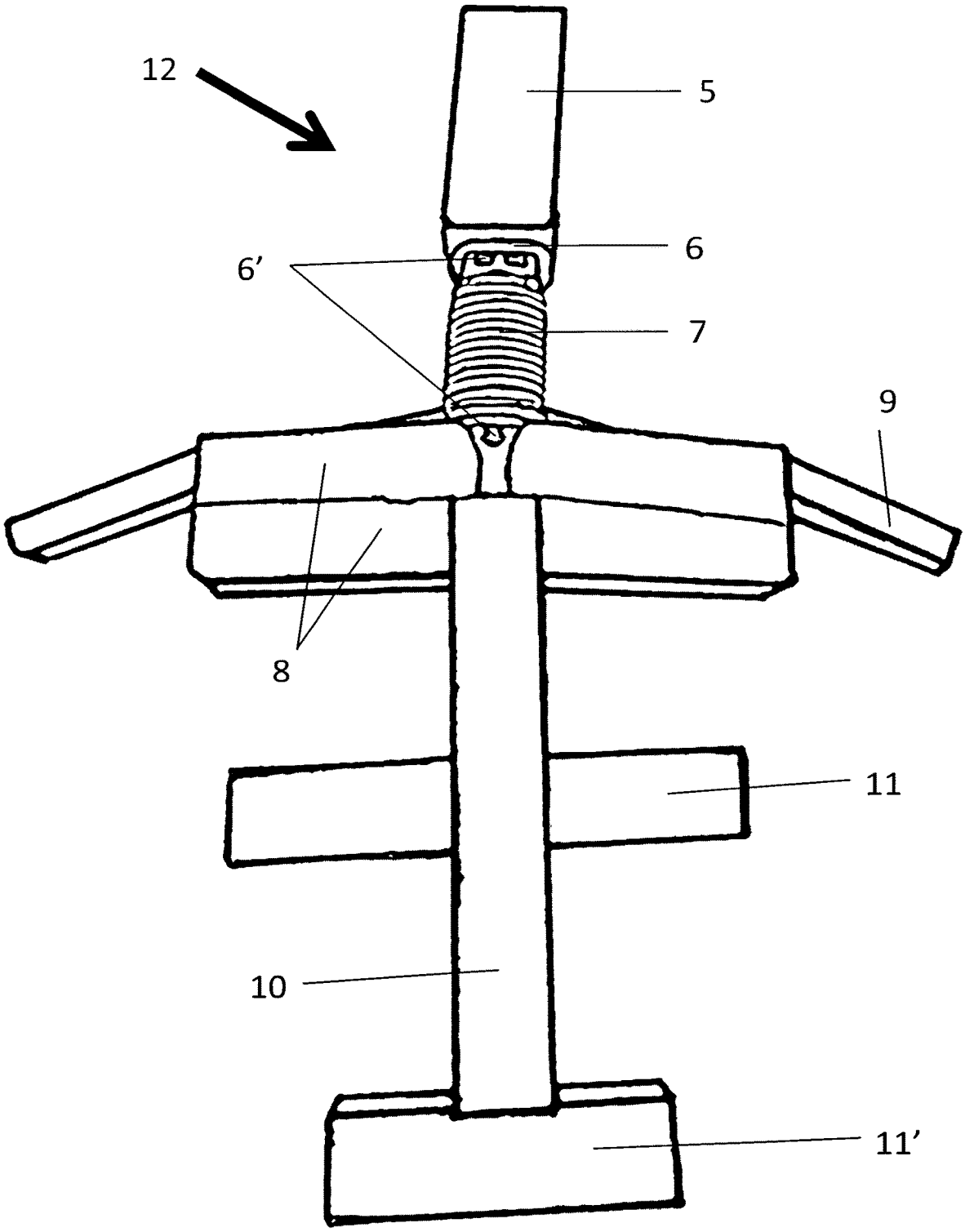
FIG. 2 schematically illustrates a front view of the interior frame structure of kicking/punching device according to the present invention.
Figure 5:
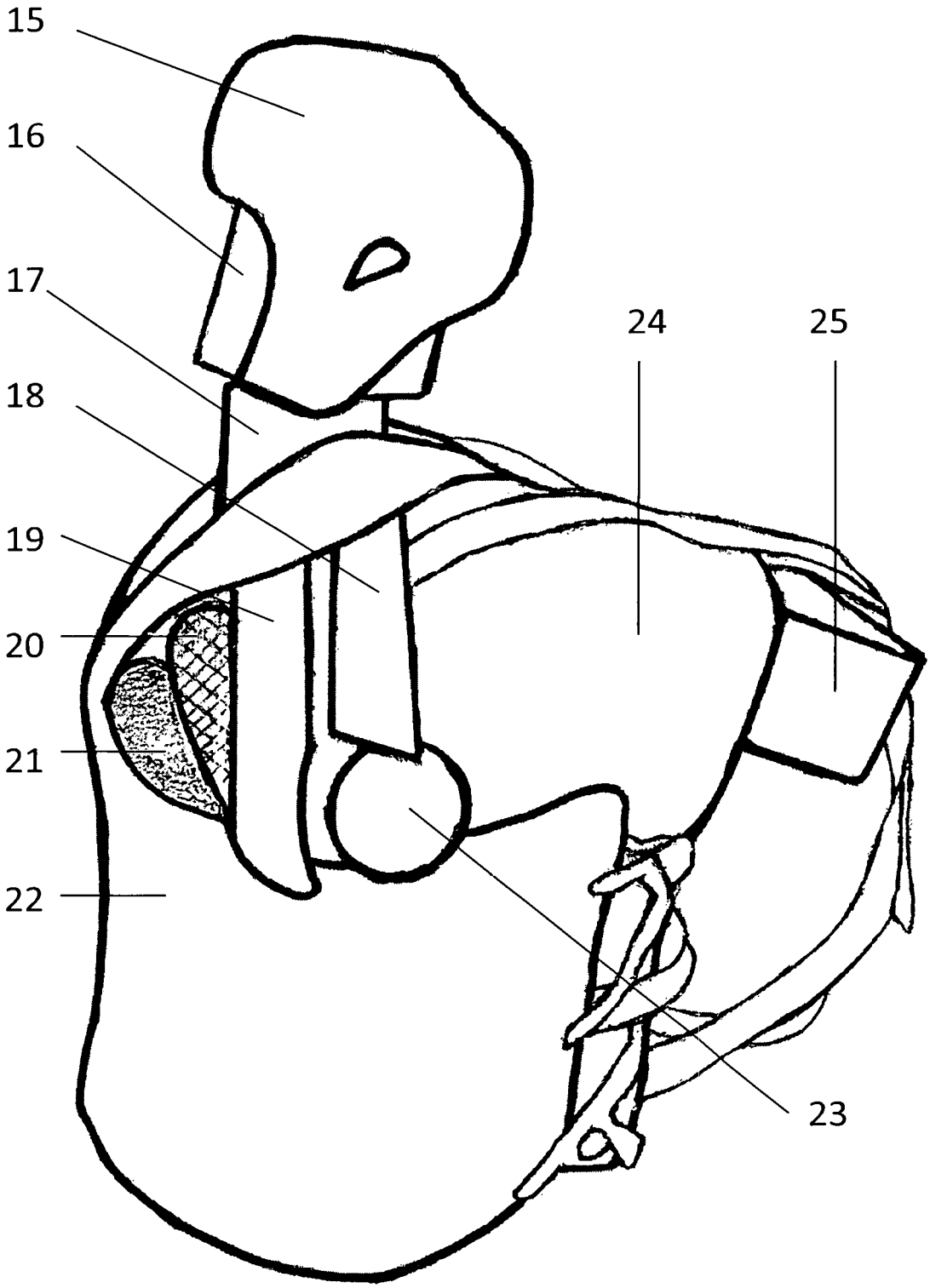
FIG. 5 schematically illustrates the interior frame structure covered with foam/padding material.

FIG. 2 illustrates the interior frame structure 12 of the portable shield device. The interior frame structure 12 comprises a head frame structure 5, a spring frame structure "spring" 7, a chest frame structure 8, a holding arms frame structure 9, a spine frame structure 10, abdomen frame structure 11 and a lower abdomen frame structure 11'. With reference to FIGS. 1 and 5, the head frame structure 5 is wrapped with protection foam/padding material 16 and a head guard 15 to form a head-like striking area 3, wherein the spring 7 is wrapped with padding material 17 to form a resilient neck-like striking area 2, the holding arms frame structure 9 is wrapped with a protection foam/padding materials 18, 19 and 23. The chest frame structure 8, the spine frame structure 10, the abdomen frame structure 11 and the lower abdomen frame structure 11' are all wrapped with protection foam/padding materials 20, 21, 22, 24 and 25 to form a central striking area 1 the holding arms frame structure 9 are connected to the chest frame structure 8. The head frame structure 5, the spring neck structure 7, the chest frame structure 8, the holding arms frame structure 9, the spine frame structure 10, the abdomen frame structure 11 and a lower abdomen frame structure 11' are connected to each other via welding and/or bolts or any other suitable fastening mechanism may be used.

Figure 3:
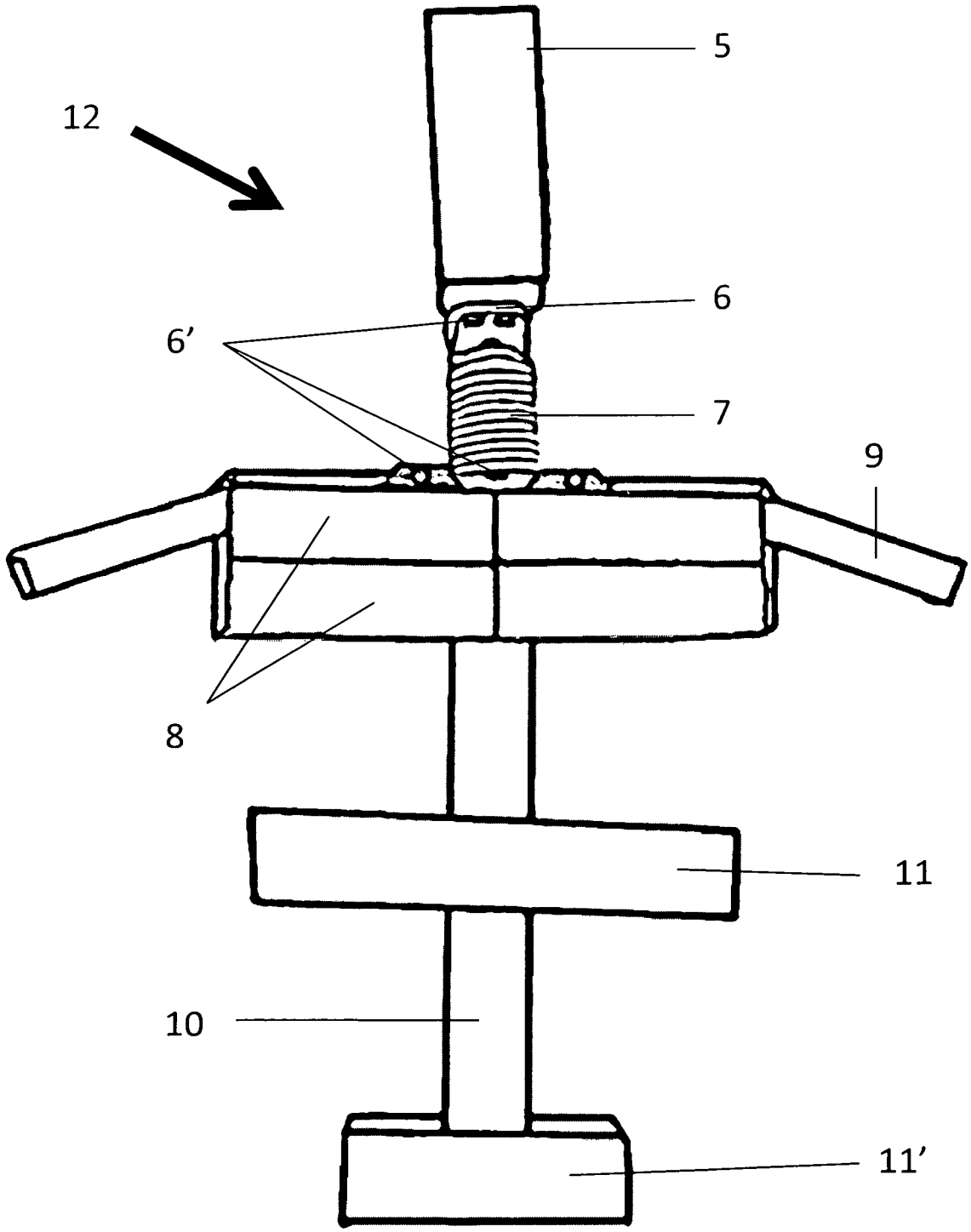
FIG. 3 schematically illustrates a back view of the interior frame structure of the kicking/punching device according to the present invention.

FIG. 3 illustrates the back view of the interior frame structure of the portable shield device comprising all the elements described in FIG. 2.

Figure 4:
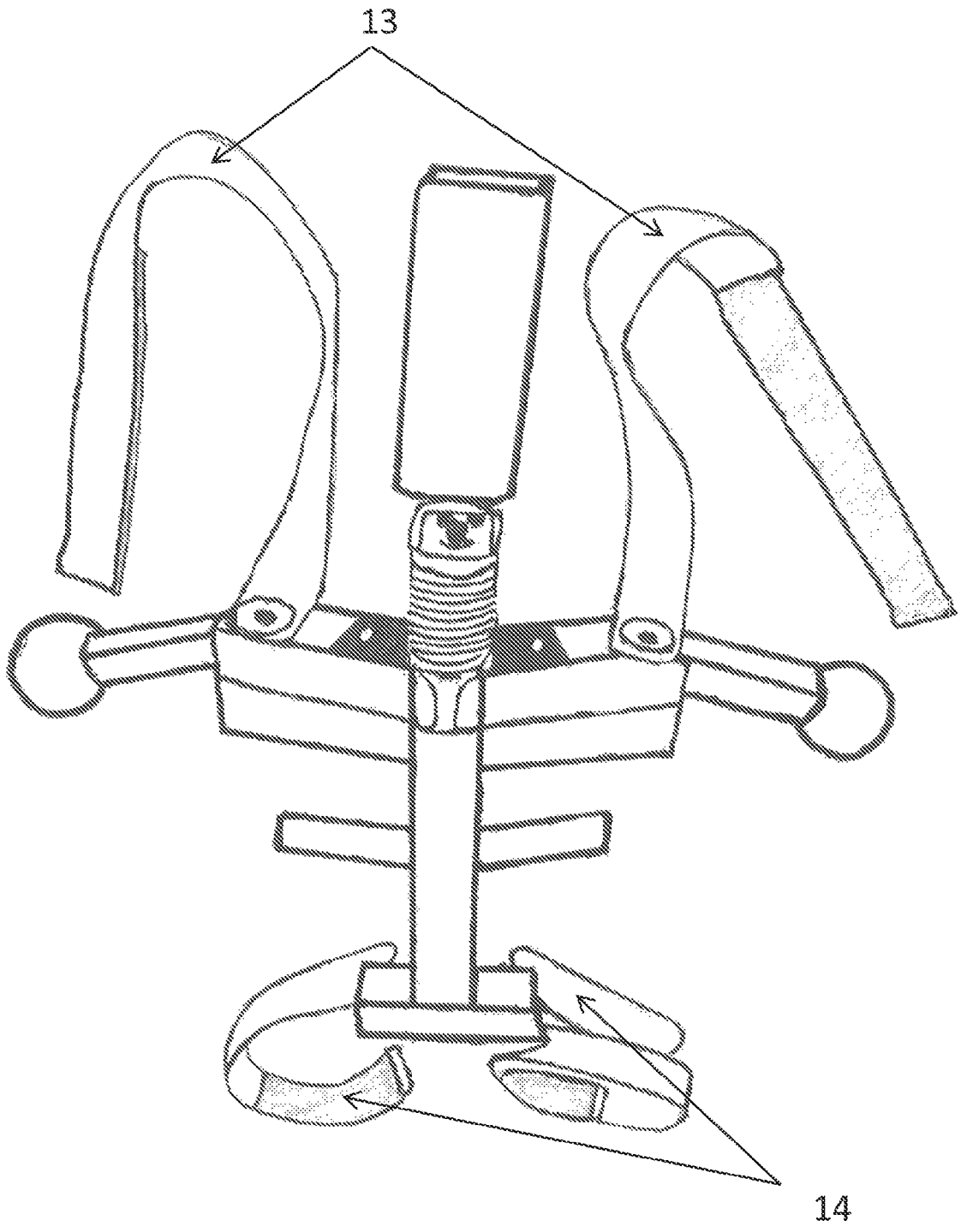
FIG. 4 schematically illustrates a front view of the interior frame structure of the kicking/punching device including a straps assembly according to the present invention.

FIG. 4 shows a first straps assembly 13 connected to the chest frame structure 8 and a second straps assembly 14 connected to the lower abdomen frame structure 11'.

FIG. 5 shows the interior frame structure of the portable shield all wrapped with foam/padding material to protect the athlete from injuries. The head-like striking area 3 comprises padding material 16, which covers the head frame structure 5 and a head guard 15 placed on top of the padding material 16. The resilient neck-like striking area 2 is wrapped by padding material 17. The central striking area 1 comprises in the front three layers of protection foam/padding material 20, 21, 22 and in the back two layers of protection foam/padding material 24, 25. The holding arms frame structure 9 is wrapped with protection foam/padding materials 18, 19 and 23. The central striking area 1 could have one, two, three or more padding layers in the front and back depending on the desired softness or hardness of the striking area.

Figure 6:
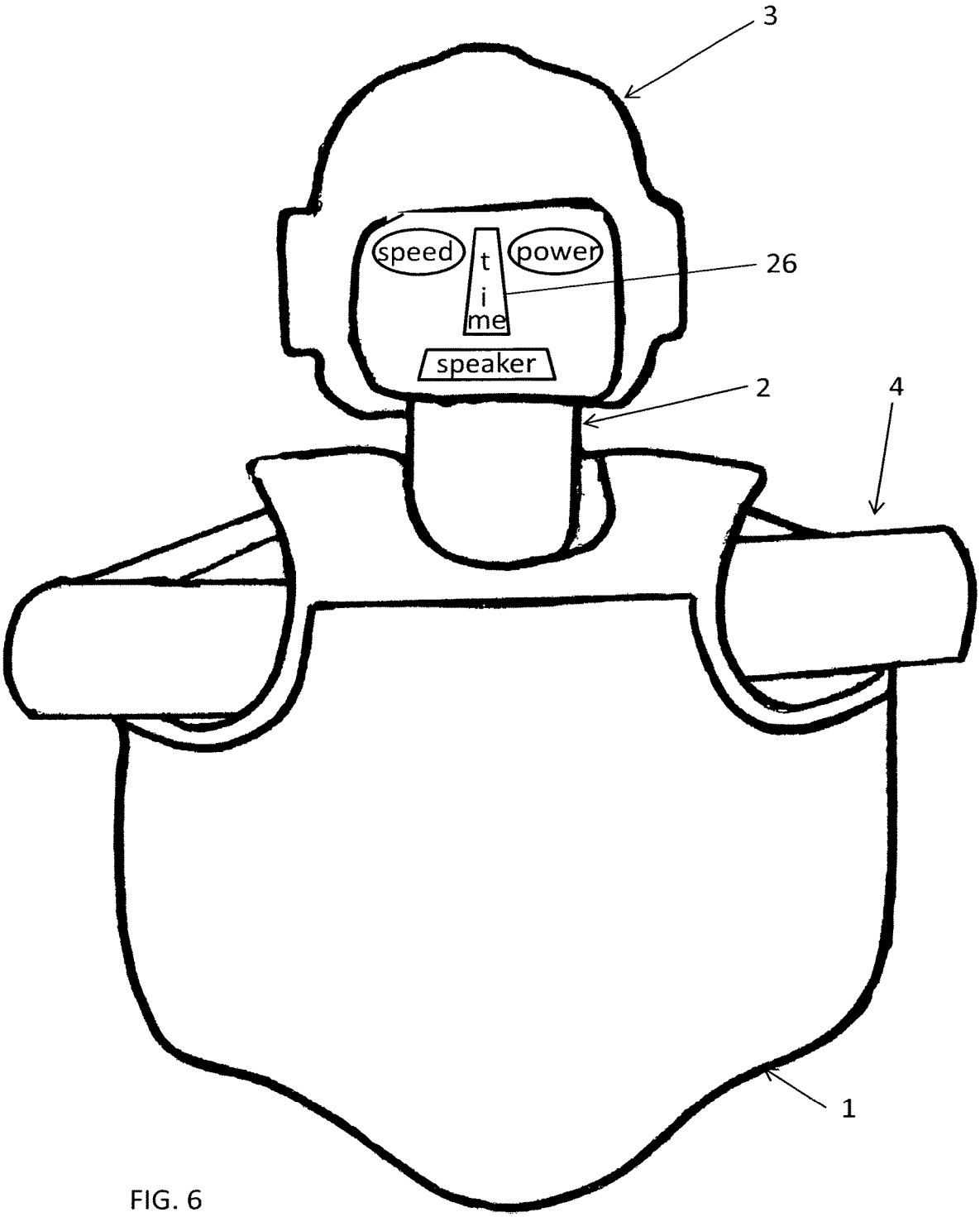
FIG. 6 schematically illustrates the kicking/punching device including a data collection/transmission unit (alternative embodiment).
Figure 7A:
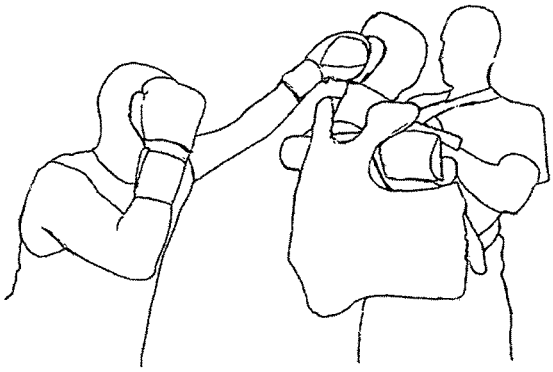
FIGS. 7A-7D schematically illustrates the kicking/punching portable shield being carried by a training partner/holder and being used for: punching to the head-like striking area with left arm (FIG. 7A); punching to the central striking area with right arm (FIG. 7B); punching to head-like striking area with right arm (FIG. 70); and punching to the head-like striking area with right elbow (FIG. 7D).
Figure 7B:
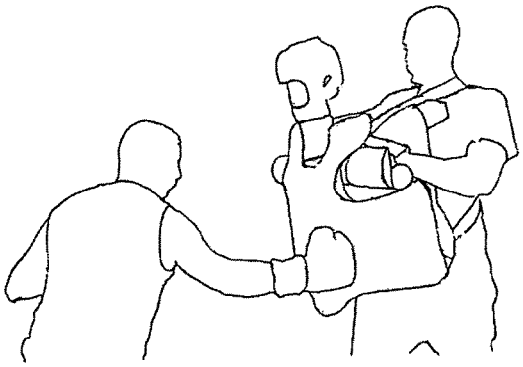
Figure 7C:
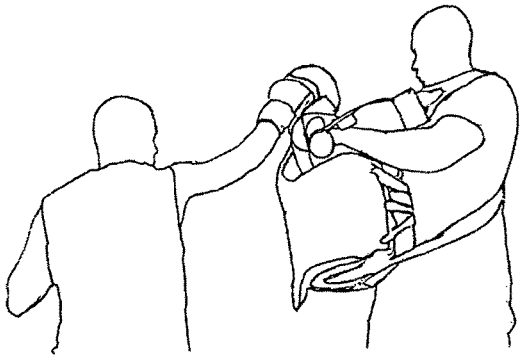
Figure 7D:
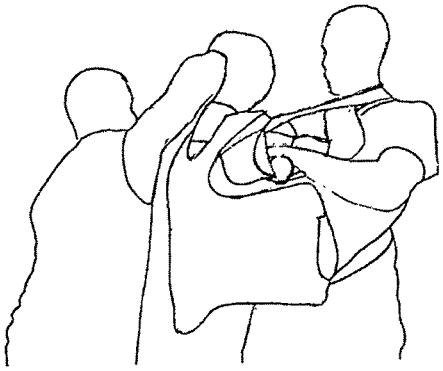
Figure 8A:
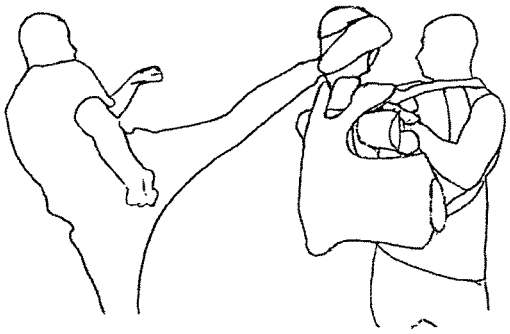
FIGS. 8A-8F schematically illustrates the kicking/punching portable shield being carried by a training partner/holder and being used for: kicking to the head-like striking area with high side kick (FIG. 8A); kicking to the head-like striking area with roundhouse kick (FIG. 8B); kicking to central striking area with low side kick (FIG. 8C); kicking to the head-like striking area with axe kick (FIG. 8D); kicking to central striking area with back kick (FIG. 8E); and kicking to central striking area with knee kick (FIG. 8F).
Figure 8B:
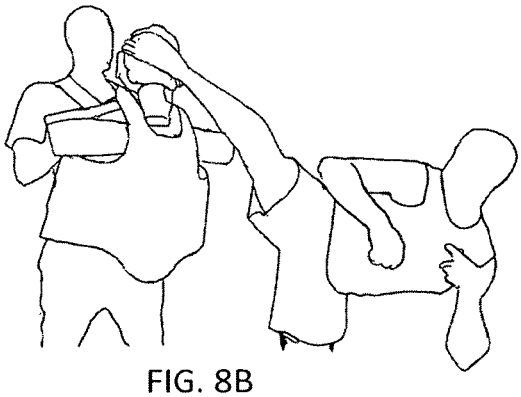
Figure 8C:
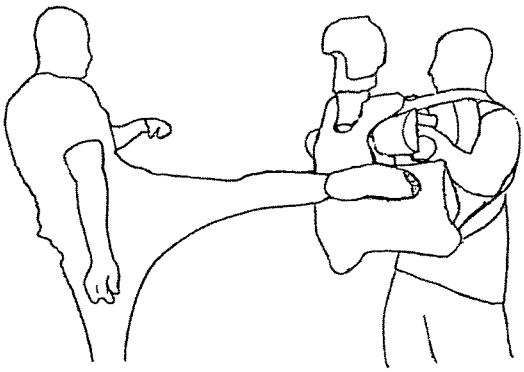
Figure 8D:
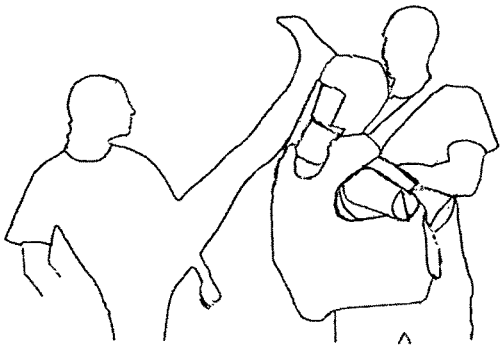
Figure 8E:
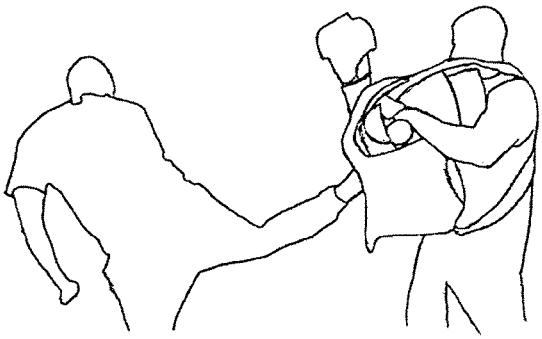
Figure 8F:
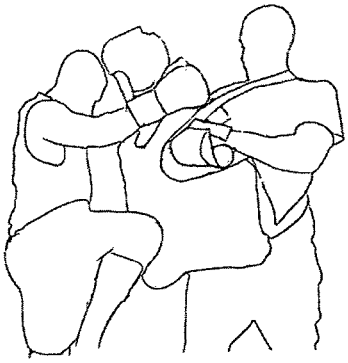

FIG. 6 shows an alternative embodiment of the portable shield having a data collection/transmission control unit 26 configured to gather information during each training session. The data collection/transmission control unit is illustrated as being placed in the head-like striking area 3;

however, the data collection/transmission control unit 15 can be placed in the central striking area 1 or at any other location in the portable shield device.

FIG. 7 shows the portable shield being carried by a training partner/holder and being used for punching by an athlete.

FIG. 8 shows the portable shield being carried by a training partner/holder and being used for kicking by an athlete.

This written description uses examples to disclose the invention, including the best mode, and also to enable any person skilled in the art to practice the invention. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

LIST OF REFERENCE NUMERALS

1 Central striking area
2 Resilient neck-like striking area
3 Head-like striking area
4 Holding arms
5 Head frame structure
6 n-shape metal band
6' Fasteners
7 Spring frame structure "Spring"
8 Chest frame structure
9 Holding arms frame structure
10 Spine frame structure
11 Abdomen frame structure
11' Lower abdomen frame structure
12 Interior frame structure assembly
13 First straps assembly
14 Second straps assembly
15 Head guard
16 Head frame structure protection foam/padding
17 Spring protection foam/padding
18 Holding arms protection foam/padding
19 Holding arms front side protection foam/padding
20 Chest frame structure protection foam/padding (third layer)
21 Chest frame structure protection foam/padding (second layer)
22 Chest frame structure protection foam/padding (first layer)
23 Holding arms side protection foam/padding
24 Back protection foam/padding (second layer)
25 Back protection foam/padding (first layer)
26 Data collection/transmission control unit

The invention claimed is:

1. A portable fighting arts training device for practicing kicking and punching techniques, the Portable fighting arts training device comprising:

a head-like striking area having an outside surface against which said kicking and punching is directed;

a resilient neck-like striking area for resiliently supporting the head-like striking area, wherein said resilient neck-like striking area comprises a spring for allowing movement of the head-like striking area when said head-like striking area is struck;

a central strking area having an external surface against which said kicking and punching is directed, the central striking area representing a chest and stomach of an opponent, wherein the central striking area is connected to the head-like striking area by the resilient neck-like striking area, wherein the cetral striking area comprises holding arms to steer the central striking area;

a straps assembly including at least two straps attached to the central striking area; and an interior frame structure assembly having having a first member having a first longitudinal end and a second longitudinal end, a second member at the first longitudinal end and extending substantially perpendicular to the first member, a third member at the second longitudinal end and extending substantially perpendicular to the first member and a fourth member between the first longitudinal end and the second longitudinal end and extending substantially perpendicular to the first member.

2. The portable fighting arts training device of claim 1, wherein said central striking area is generally cylindrically curved.

3. The portable fighting arts training device of claim 1, wherein said resilient neck-like striking area is interchangeable to different length sizes.

4. The portable fighting arts training device of claim 1, wherein the head-like striking area, the resilient neck-like striking area and the central striking area are wrapped with padding material.

5. The portable fighting arts training device of claim 4, wherein the padding material is interchangeable to softer or harder padding material.

6. The portable fighting arts training device of claim 1, further comprising attachable arms and legs to the central striking area.

7. The portable fighting arts training device of claim 1, further comprising a data collections and transmission control unit configured to gather information during a training session, wherein said information includes at least one of duration time of the training session, heart rate, number of calories burned, power and speed of punches and/or kicks.

8. The portable flghting arts training device of claim 1, wherein the interior frame structure assembly further comprises: a head frame structure and a spring frame structure, wherein the head frame structure is wrapped with padding material to form the head-like striking area, wherein the spring frame structure comprises the spring which is wrapped with padding material to form the resilient neck-like striking area, and wherein the first member, the second member, the third member and the fourth member are all wrapped with padding material to form the central striking area.

9. The portable fighting arts training device of claim 8, wherein the holding arms are wrapped with padding material and integrally connected to the second member.

* * * * *